United States Patent [19]

Diamond

[11] Patent Number: 4,457,320

[45] Date of Patent: Jul. 3, 1984

[54] COIN IDENTIFICATION UNIT AND COIN SEPARATOR THEREFOR

[76] Inventor: Norman Diamond, 60 Greenbriar Dr., Deerfield, Ill. 60015

[21] Appl. No.: 311,781

[22] Filed: Oct. 15, 1981

[51] Int. Cl.[3] ..... G07D 5/08

[52] U.S. Cl. ..... 133/5 R; 133/8 E; 194/100 A

[58] Field of Search ..... 133/3 F, 8 A, 8 D, 8 E, 133/8 R; 232/7, 12; 194/100 A; 221/162

[56] References Cited

U.S. PATENT DOCUMENTS

| | | | |
|---|---|---|---|
| 719,459 | 2/1903 | Goetze et al. | 133/8 E |
| 3,699,981 | 10/1972 | Connant et al. | 133/8 |
| 3,910,295 | 10/1975 | Fletcher | 133/8 R |
| 3,930,512 | 1/1975 | Woodland | 133/3 |
| 3,939,954 | 2/1976 | Collins | 194/102 |
| 4,041,280 | 8/1977 | Ohsako et al. | 235/92 |
| 4,172,462 | 10/1979 | Uchida et al. | 133/3 |
| 4,178,502 | 12/1979 | Zimmerman | 235/92 |
| 4,210,801 | 7/1980 | Gomez et al. | 235/92 |
| 4,226,253 | 10/1980 | Kokubo et al. | 133/4 A |
| 4,230,136 | 10/1980 | Heinrichs | 133/3 E |
| 4,323,148 | 4/1982 | Nichimoto et al. | 194/100 A |

FOREIGN PATENT DOCUMENTS

| | | | |
|---|---|---|---|
| 2227191 | 1/1974 | Fed. Rep. of Germany | 133/8 E |
| 1445028 | 8/1976 | United Kingdom | 133/3 F |

*Primary Examiner*—Stanley H. Tollberg

*Attorney, Agent, or Firm*—Fitch, Even, Tabin & Flannery

[57] ABSTRACT

Coins that are overlapped in a coin identification device are separated by opposed frictional surfaces driven in opposite directions. A primary frictional surface may be on a downwardly traveling belt and a secondary frictional surface may be as upwardly traveling roller surface. Coins which are engaged edge-to-edge may be separated by a deflector which retards the descent of one coin to separate it vertically from the other coin. The roller is mounted on a pivotal plate which moves to increase the space between frictional surfaces to alleviate jamming.

8 Claims, 5 Drawing Figures

COIN IDENTIFICATION UNIT AND COIN SEPARATOR THEREFOR

BACKGROUND OF THE INVENTION

The present invention relates to a coin identification unit having a coin separation device and having particular application in mass transit fare collection.

Fares on a transit bus are usually collected by means of a farebox. The common farebox accepts coins and/or tokens and the driver, acting in the capacity of a fare monitor, counts the deposited coins and adds their values to verify that the correct fare is deposited. Since fares often involve the insertion of multiples of various denominations in irregular sequence, the monitoring process can be difficult and error-prone, especially upon the rapid boarding of passengers.

Automatic tabulation and summation of coins is desired to supplement the monitoring by the driver. The tabulations, which may also be recorded, provide additional reliability to the fare collection process and serve to deter fraudulent activities on the part of the driver or other personnel.

Mechanical counters are employed in fareboxes which count the coins subsequent to their being viewed by the driver. However, it is more desirable to have the coins be displayed after the automatic counting so that the driver can ascertain whether a misreading has occurred and so a passenger can be shown the amount deposited. It is necessary that such a device operate rapidly so that successive fares may be distinguished.

Devices which count before displaying have been proposed, for example, in U.S. Pat. Nos. 3,939,954 and 4,210,801. Most part existing devices are rotary devices, which can jam if excessive coins are inserted simultaneously. A disadvantage of the rotary devices is that when a jam occurs or the rotary motor fails, these devices become inoperative. Furthermore, existing devices often employ opto-electronics requiring the coin to break one or more light beams between light emitting diodes and phototransistors. Environmental vibration of a bus often renders false readings and the dirt to be found on coins and in the air can cover either the light transmitter or receiver, again, causing false readings. Another problem with the rotary device is that the diameter of the device must be larger than twice the diameter of the largest coin to be processed. Considering that space is at a premium within a farebox, this size constraint poses certain packaging problems.

It is an object of the present invention to provide a new and improved compact coin identification unit with a coin separating device. The unit may be relieved of jammed coins and may accept coins in the event of loss of motive power.

SUMMARY OF THE INVENTION

In a coin identification unit, coins traverse a generally linear path passing between opposing frictional surfaces and overlapping coins are separated thereby. The directly related to separated coins may then be individually examined to determine parameters each coin's unique mass and composition characteristics that correspond to its assigned value.

The identification unit incorporates a singulator with a motor for driving at least one frictional surface in a generally downward direction to guide coins along a channel and to separate overlapping coins coming between the two frictional surfaces. In one preferred embodiment a motor drives a belt and a roller so that the belt provides a downwardly moving frictional surface and the roller provides an upwardly moving frictional surface adjacent the channel. Thus, when two stacked coins come between the roller and the belt, the coin nearer the roller is urged upward while the coin nearer the belt is forced downward so that the coins are separated.

One of the frictional surfaces is mounted on a restorably displaceable plate. When a jam is initiated, the plate is displaced to enlarge the channel, allowing an offending coin or coins to pass. If the motor fails, the plate may be manually displaced to allow coins to fall unimpeded.

A deflector strip serves to vertically separate coins exiting the region between the opposing frictional surface side-by-side. In effect, the strip serves to define a bottleneck through which only one nonoverlapping coin may pass at a time. Preferably, the strip is formed of spring steel and is fastened at only one end so that the strip is displaceable by the diameter of the large coins which are thus allowed to pass.

One by one, the singulated coins pass a sensing device which includes an oscillator circuit with a coil adjacent a lower portion of the channel. The characteristic frequency of the oscillator circuit is altered in a known manner by a coin passing adjacent thereto in accordance with its mass and composition. By analyzing these fluctuations in oscillator frequency the identity of the coin can be established. Further means can be provided to sum denominations by fare, trip and/or day.

DESCRIPTION OF THE PREFERRED EMODIMENT

Figure 1:
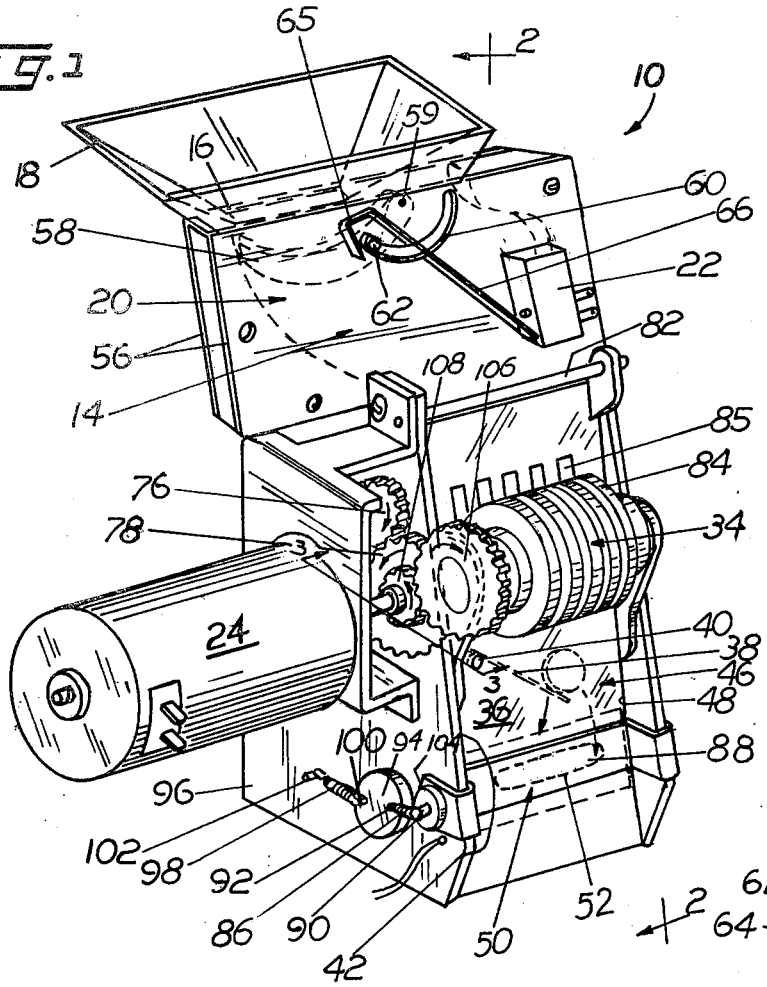
FIG. 1 shows a perspective view of the coin unit.
Figure 2:
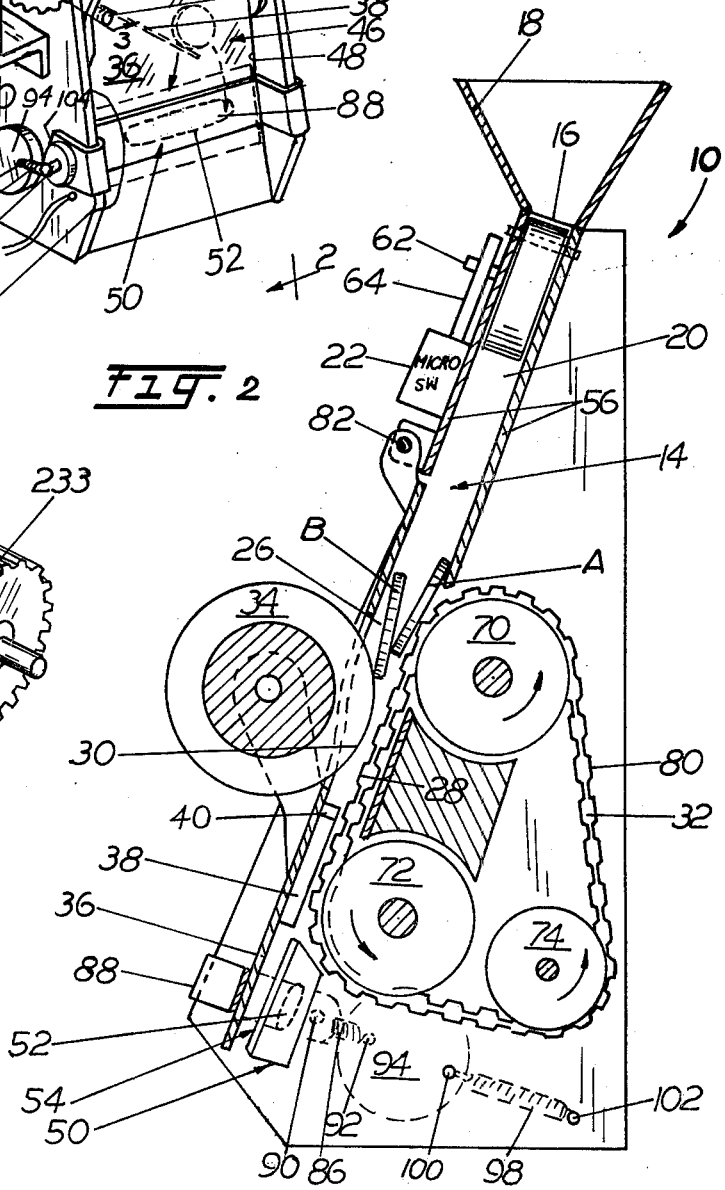
FIG. 2 shows a side sectional view of the unit.

In accordance with the present invention, a coin identification unit 10, illustrated in FIGS. 1 and 2, incorporates a primary frictional surface 28 moving downwardly relative to a secondary frictional surface 30 to separate overlapping coins.

In the preferred embodiment, the primary frictional surface 28 is included in an endless belt 32 driven by means such as a motor 24; the motor 24 also drives a roller 34, hereinafter called the "secondary roller" which includes the secondary frictional surface 30. The motor 24 may be actuated by a microswitch 22 closed by the weight of a coin inserted into the unit 10.

In order to alleviate jams, it is desirable that means are provided so that the frictional surfaces 28 and 30 are displaceable with respect to one another so as to widen the spacing therebetween. In the illustrated embodiment the secondary roller 34 is mounted upon a displaceable plate 36 which is pivotable against restoring forces provided by springs 86. When one or more coins coming between the frictional surfaces 28 and 30 cannot be accommodated by the usual spacing therebetween, the coins force the displaceable plate 36 to pivot creating a larger space between the frictional surfaces 28 and 30 through which the one or more coins may then pass.

The coin identification unit also includes a deflector means for retarding the progress of one of two small coins traveling side-by-side; in the illustrated embodiment, this function is served by a strip 38 of spring steel attached by rivet 40 adjacent on edge 42 of a coin guiding channel 14 and extending diagonally downward and part way across the channel 14, leaving an opening 46 adjacent the other edge 48 of the channel 14. When two coins approach the strip 38 side-by-side, the coin adjacent the edge 40 has its progress retarded by the strip 38 so that the coins continue their descent one at a time.

Subsequent to passing the deflector strip 38, the coins fall past a coin sensing device 50. Preferably, the coin sensing device 50 incorporates a coil 52 adjacent to which the falling coins pass. The coil connected to an oscillator circuit. Each coin, by disturbing the electromagnetic field of the coil 52, affects the frequency output of the circuit in a known manner in accordance with the mass and composition of the coin. Accordingly, the denomination of each coin can be determined by analyzing the output of the oscillator circuit. The data can be stored and summed by known means to determined totals for individual fares and aggregates thereof. After passing the coin sensing device 50, the coins descent into a display chamber, not shown, for ready viewing.

Describing the preferred embodiment of the present invention in greater detail, the coin identification unit 10 includes a hopper 18 which funnels coins into the entry chute 20 through the slot 16. The entry chute 20, defined by parallel plates 56 is curved in a direction perpendicular to the plates so that the coins are slowed for more facile processing. The curved chute 20 also provides a labyrinth path to deter the entry of non-coinlike objects and to render more difficult the withdrawal of an inserted coin.

The entry chute 20 includes means for closing the motor activating microswitch 22. In the preferred embodiment, this means includes a piece of metal in the form of a crescent with a thickness slightly less than that of the chute. The crescent 58 is attached at one end 59 so that it can be pivoted by the weight of a coin. Affixed to the crescent and projecting through a curved slot 60 in one of the plates 56 defining the entry chute is an engaging member 62 for engaging a hook 65 on an arm 66 of the microswitch 22. When the crescent 58 is displaced by a coin, the engaging member 62 moves the arm 66 so as to close the microswitch 22 actuating the motor 24 by circuit means (not shown).

At the base of the entry chute 20 is the holding chamber 26 in communication with a space between the frictional surfaces which has a depth equal to or slightly greater than other thicknesses of the thickest coin to be processed. In the preferred embodiment, the primary frictional surface 28 is provided by the endless belt 32 mounted on a drive roller 70, a guide roller 72 and a tensioning roller 74. The drive roller 70 is linked to the motor 24 via a drive roller gear 76 and the larger 78 of two motor gears. The drive roller 70 and the guide roller 72 are situated so that a portion of the belt 32 always extends along one side of the coin guiding channel 14. When the motor 24 is actuated, the belt 32 rotates so that the portion adjacent the channel 14 moves downwardly.

Figure 4:
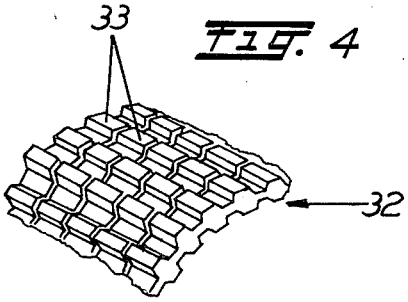
FIG. 4 shows the two sided timing belt.

The outer surface 80 of the belt 32 is of a frictional material and texture. In the illustrated embodiment five belts, commonly referred to as two-sided timing belts, shown in FIG. 4 positioned side-by-side constitute the belt 32 of the coin identification unit. Alternatively, a wider unitary belt could be used and surfaces employed having a frictional pile. When the motor 24 is actuated, the belt 32 rotates so as to provide a downwardly moving surface adjacent the channel 14.

The downwardly moving primary frictional surface 28 adjacent the channel serves to urge adjacent coins downwardly through the channel 14. In the illustrated embodiment, the belt 32 and the channel 14 are inclined so that a coin remains in contact with the belt 32, which serves to propel and support the coin as it travels through the channel 14. This support helps to offset the disturbing influence vehicle motion and vibration on the identification unit 10 when used in mass transit applications.

Defining a portion of the coin guiding channel 14 opposite the belt 32 is the displaceable plate 36, which normally extends parallel to the primary frictional surface 28 provided by belt 32, pivotally mounted on a pivot pin 84. A secondary frictional surface 30 is provided by a roller 34 with circumferential ridges 84. The ridges 84 extend through slots 85 in the displaceable plate 82. The motor 24 drives the secondary roller 34 so that the ridges 84 move upwardly adjacent to the channel 14. The ridges 84, which are formed of frictional material such as rubber, serve to urge coins adjacent thereto in an upwardly direction. The coefficient of friction of the ridges 84 is less than that of the belt 32 so that a coin contacting both frictional surfaces 28 and 30 is urged downwardly. However, when two stacked coins come between the frictional surfaces 28 and 30, the coin B adjacent the seconday roller 34 is urged upward and off the other coin A, which is urged downward by the belt 32.

Figure 3:
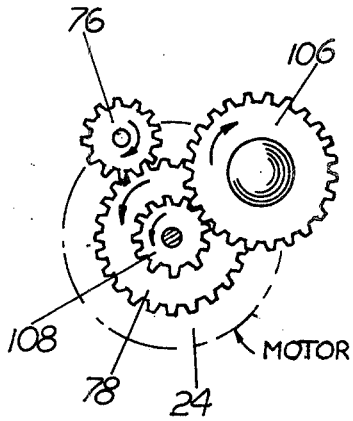
FIG. 3 shows a gear driving arrangement.

The motor 24 drives the secondary roller 34 via a secondary roller gear 106 and the smaller gear 108 of the two motor gears. In the illustrated embodiment, the ratio of the diameters of the larger 78 over the smaller motor gear 108 is 2:1; the ratio of diameters of the secondary roller gear 106 over the drive roller gear 76 is also 2:1. With the gears as illustrated in FIG. 3, the drive roller 76 is rotated at four times the rate that the secondary roller 106 is driven. In the illustrated embodiment, both the drive roller 76 and the secondary rollers 106 have approximately 1" diameters so that the belt 32 moves about four times as fast as the surface 30 of the secondary roller 106. Accordingly, when the motor 24 is actuated, the illustrated embodiment provides a primary frictional surface 28 moving downwardly at about four times the rate that the secondary frictional surface 30 moves upwardly. This helps insure the generally downward flow of coins, while providing a means for separating stacked coins by the action of the secondary roller 34.

Because the coin identification unit 10 is to be used with different size coins, the channel 14 is designed with a thickness at least as great as the thickness of the thickest coin to be identified and a width at least as great as the diameter of the largest coin to be identified. Accordingly, while stacked coins do not normally exit the belt 32 simultaneously, it is possible for coins with lesser diameters to exit the belt at about the same time, e.g., sharing an altitude side-by-side. Since the coins are to be identified one at a time, deflector means may be provided to delay one of two side-by-side coins relative to the other.

In the preferred embodiment, the deflector means is in the form of the strip and spring steel attached to one side of the plate 82 and below the secondary roller 34.

The strip 38 extends from the point of attachment adjacent an edge 42 of channel 14 diagonally down and part way across the channel 14. As the belt 32 progresses side-by-side coins, the coin adjacent the edge 48 opposite the point of attachment exits first, while the coin nearer the point of attachment must depress the deflector strip 38 and/or roll down the strip 38 towards the opposite side, delaying its exit. The coins thus fall from the belt 32 one at a time to facilitate accurate identification by the coin sensing device 50.

The displaceable plate 36 upon which the secondary roller 34 and the deflector strip 38 are mounted is rotatable about a pivot pin 82 against a restoring force. The restoring force is provided by plate restoring springs 86, which are attached at one end to a bracket 88, rigidly attached to the displaceable plate 82. The bracket 88 includes spring engaging means or projections 90 to facilitate connections.

The ends of the springs not attached to the bracket 88 are connected to pegs 92 affixed to cams 94 on side plates 96. The cams 94 are manually rotatable about an off-center axis located toward the bracket 88 from the centers of the cams 94 when they are in their normal position by cam restoring springs 98 attached at one end to pegs 100 on the cams and at the other by pegs 102 protruding from the side plates 96. By means not shown, the cams 94 may be rotated against the restoring forces so as to press against the extreme ends 104 of the bracket and displace the displaceable plate 36 thereby widening a portion of the channel 14. Thus, the cams 94 may be used to free jams or to permit coins to pass through the separator 12 without the belts moving as may be necessitated when the motor 24 becomes inoperative for any reason. The backing plate is also displaceable by the internal forces generated by jams, so that some jamming is alleviated automatically.

Once past the deflector strip 38, coins fall past the electrical coil 52 associated with the oscillator circuit consituting the coin sensing device 50. The coil 52 is oblong to provide maximal coupling effect between a coin and the coil 52 while minimizing the residence time of a coin on the coil 52 so there is less chance of two coins falling sequentially being read as one. The coil is imbedded in the dielectric plate 54 so as to provide no protrusions in the coin path. The presence of a given coin near the dielectric plate 54 changes the inductance of the coil 52 which, in turn, changes the frequency of the oscillator. By comparing the sensed frequencies with known parameters in terms of the frequency shift to a maximum and then a decline, identification can be made of a particular coin passing over the coil 52. In other words, each coin, in accordance with its size, mass and composition, affects the frequency output in a determined and identifiable way. Thus, coins may be identified according to denomination, and their values may be summed to yield a readout for each passenger and totals for any appropriate administrative interval.

The present invention offers several advantages over the rotary devices discussed above. The linear path provided by the present invention allows a compact device through which coins may be processed rapidly. The rapid processing is especially important in mass transit applications where fares are collected in quick succession.

Since the opposing frictional surfaces are relatively displaceable, the present identification unit is more resistant to jamming than rotary units. Furthermore, by locking the frictional surfaces to provide a widened channel therebetween, the coins can be identified by the coin sensing device and displayed for viewing after bypassing the separation apparatus. Thus, unlike the rotary devices, the present unit is not rendered totally inoperable when, for exanple, the motor fails.

The use of the conveyor belt provides support through the channel so that mechanical motions and vibrations inherent in mass transit applications are damped. The oscillator circuit in the coin sensing device is less susceptible to errors due to dirt and mechanical vibration that can impair the functioning of the opto-electronic coin sensing devices.

Figure 5:
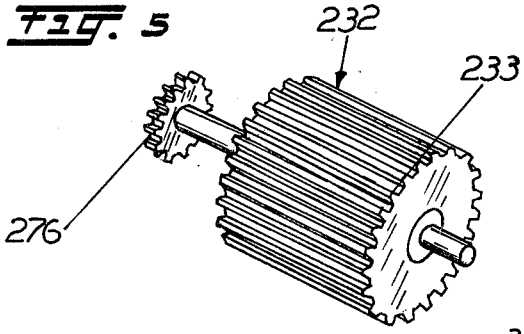
FIG. 5 shows an alternative embodiment of primary roller.

In summary, the present invention provides a compact, rapid, and reliable coin identification unit which is resistant to jamming and errors due to mechanical vibrations and dirt. Many modifications are possible within the scope of the present invention. In an alternative embodiment, a primary roller 232 (FIG. 5) provides a primary frictional surface. The primary roller has longitudinal ridges 233 to enhance the frictional characteristics of the surface. Associated with the primary roller 232 is a primary roller gear 276 to connect the primary roller 232 to a motor.

In the embodiments, the secondary frictional surface may remain stationary, or even move downwardly, provided the separating effect is retained. The primary frictional surface might be spring loaded rather than the secondary frictional surface. Other modifications are possible without exceeding the spirit and scope of the present invention.

What is claimed is:

1. An apparatus for separating overlapping disks dropping to a receiver comprising:

means including an endless belt having a primary frictional surface for engaging a first disk of the overlapping disks and for imparting a force thereto in a predetermined direction;

means for providing a secondary frictional surface for engaging a second disk of the overlapping disks and for retarding the motion of the second disk in the predetermined direction to separate the disks from each other;

means for driving each of said frictional surfaces; and means for introducing disks between said primary and secondary frictional surfaces;

said means for providing a secondary frictional surface including a pivotable plate and a roller with said secondary frictional surface thereon, said roller being mounted on said plate, said plate being pivotable so as to increase the spacing between said roller and said primary frictional surface so as to alleviate jamming.

2. A coin identification apparatus comprising:

channel means for defining a coin guiding channel having first and second opposing sides and first and second opposing edges, said channel having a width at least as great as the maximum coin diameter and a thickness at least as great as the maximum coin thickness, said channel being defined so that coins can travel in a generally downward direction therethrough while being oriented so that the axis of each coin is generally perpendicular to the direction of coin travel;

means for providing a primary frictional surface along the first side of said channel for engaging a first coin and for imparting a force thereto in a generally downward direction;

means for providing a secondary frictional surface along the second side of said channel and opposite the primary frictional surface for engaging a coin covering the first coin and for retarding the downward motion of the second coin to separate the coins from each other;

means for driving each of said frictional surfaces with the primary frictional surface traveling upwardly and the secondary frictional surface traveling downwardly;

means for displacing at least one of said frictional surfaces relative to the other so as to widen said channel to alleviate jams;

deflector means for retarding the descent of a coin falling adjacent said first edge of said channel so as to separate it vertically from a coin adjacent said second edge of said channel sharing the same altitude so that the coins proceed down the channel one at a time; and a coin sensing device for determining the denomination of a descending coin.

3. The coin identification unit of claim 2 further characterized in that the coin sensing device includes an oscillator circuit with a coil adjacent a lower portion of said channel so that a coin passing thereby can be identified in accordance with its mass and composition by the changes it effects in the electrical output of the oscillator circuit.

4. The coin identification unit of claim 2 further characterized in that the means for driving endless belt frictional surface includes a motor, said motor driving said primary frictional surface downwardly adjacent said channel and said secondary frictional surface upwardly adjacent said channel.

5. A coin identification apparatus comprising:

channel means for defining a coin guiding channel having first and second opposing sides and first and second opposing edges, said channel having a width at least as great as the maximum coin diameter and a thickness at least as great as the maximum coin thickness, said channel being defined so that coins can travel in a generally downward direction therethrough while being oriented so that the axis of each coin is generally perpendicular to the direction of coin travel;

means for providing a primary frictional surface along the first side of said channel for engaging a first coin and for imparting a force thereto in a generally downward direction;

means for providing a secondary frictional surface along the second side of said channel for engaging a coin covering the first coin and for retarding the downward motion of the second coin to separate the coins from each other;

means for driving at least one of said frictional surfaces;

means for displacing at least one of said frictional surfaces relative to the other so as to widen said channel to alleviate jams;

deflector means for retarding the descent of a coin falling adjacent said first edge of said channel so as to separate it vertically from a coin adjacent said second edge of said channel sharing the same altitude so that the coins proceed down the channel one at a time;

a coin sensing device for determining the denomination of a descending coin;

said means for providing a primary frictional surface including an endless belt with the primary frictional surface thereon, a drive roller for driving the endless belt, a guide roller for guiding the belt along said channel, and a tensioning roller to maintain frictional contact between said drive roller and said belt so the latter can be driven.

6. A coin identification apparatus comprising:

channel means for defining a coin guiding channel having first and second opposing sides and first and second opposing edges, said channel having a width at least as great as the maximum coin diameter and a thickness at least as great as the maximum coin thickness, said channel being defined so that coins can travel in a generally downward direction therethrough while being oriented so that the axis of each coin is generally perpendicular to the direction of coin travel;

means for providing a primary frictional surface along the first side of said channel for engaging a first coin and for imparting a force thereto in a generally downward direction;

means for providing a secondary frictional surface along the second side of said channel for engaging a coin covering the first coin and for retarding the downward motion of the second coin to separate the coins from each other;

means for driving at least one of said frictional surfaces;

means for displacing at least one of said frictional surfaces relative to the other so as to widen said channel to alleviate jams;

deflector means for retarding the descent of a coin falling adjacent said first edge of said channel so as to separate it vertically from a coin adjacent said second edge of said channel sharing the same altitude so that the coins proceed down the channel one at a time; and a coin sensing device for determining the denomination of a descending coin;

said means for providing a primary frictional surface including a primary roller with the primary frictional surface thereon.

7. The coin identification unit of claim 5 further characterized in that said means for providing a secondary frictional surface includes a secondary roller with said secondary frictional surface thereon.

8. The coin identification unit of claim 7 further characterized in that the means for displacing at least one of said frictional surfaces includes a plate upon which said secondary roller is mounted, said plate being displaceable against restoring forces.

* * * * *